United States Patent [19]

Keene

[11] Patent Number: 4,847,915

[45] Date of Patent: Jul. 18, 1989

[54] BASEBALL GLOVE WITH A FLEXIBLE HEEL CONSTRUCTION

[75] Inventor: Howard B. Keene, Richmond, Va.

[73] Assignee: Figgie International, Inc., Richmond, Va.

[21] Appl. No.: 191,439

[22] Filed: May 9, 1988

[51] Int. Cl.[4] ..... A41D 13/08

[52] U.S. Cl. ..... 2/19

[58] Field of Search ..... 2/19, 161 A

[56] References Cited

U.S. PATENT DOCUMENTS 3,098,234 7/1963 Latina ..... 2/19

3,898,696 8/1975 Campanis ..... 2/19

*Primary Examiner*—Ronald Feldbaum

*Attorney, Agent, or Firm*—Senniger, Powers, Leavitt and Roedel

[57] ABSTRACT

The invention involves a baseball glove with a flexible heel construction. The glove comprises a front panel forming the front wall of the glove and a back panel forming the back wall of the glove, the front and back panels being secured together at peripheral margins of the glove to form a glove shell having finger and thumb stalls. A liner having a palm liner panel is disposed on the inside of the shell. The front panel and the palm liner panel of the glove have lower edge margins arranged so that the outside face of the front panel is in opposing face-to-face relation with the outside face of the palm liner panel. The edge margins are stitched together to form a flexible heel seam running across the bottom of the glove with the stitching being substantially concealed from view. A relatively thin flexible heel pad is disposed between the front panel and the palm liner panel above the heel seam. The front panel and the palm liner panel, as secured together by the aforesaid flexible heel seam, combine with the flexible heel pad to form a flexible heel construction which is readily flexible to facilitate closing of the glove.

12 Claims, 2 Drawing Sheets

BASEBALL GLOVE WITH A FLEXIBLE HEEL CONSTRUCTION

BACKGROUND OF THE INVENTION

This invention relates generally to baseball (and softball) gloves and more particularly to a flexible heel construction for such a glove which enables the glove more readily to be opened and closed.

The present invention has particular (albeit not exclusive) application to youth gloves, that is, gloves for children and young adults. Gloves constructed in conventional fashion are difficult to close, especially when new, because the heel of the glove is constructed in such a way that it is relatively inflexible. This is because the heel pad is usually relatively thick, and because the bottom edge of the front of the glove is typically finished with roll binding and leather lacing. This relatively inflexible construction makes closing the glove difficult, especially for children who have less hand strength. Accordingly, there is a need for a glove which is relatively easy to flex and close, even by a child.

SUMMARY OF THE INVENTION

Among the several objects of this invention may be noted the provision of a baseball glove which has a flexible heel construction permitting the glove more easily to be closed; the provision of such a glove which is designed especially (albeit not exclusively) for children and young adults; the provision of such a glove which has an attractive and finished appearance; the provision of such a glove which is of durable construction; and the provision of such a glove which is of relatively simple design for economical manufacture.

Generally a baseball glove of this invention has a flexible heel construction. The glove comprises a front panel forming the front wall of the glove and a back panel forming the back wall of the glove, the front and back panels being secured together at peripheral margins of the glove to form a glove shell having finger and thumb stalls for receiving the fingers and the thumb of the hand. The front panel has an outside face forming the front surface of the glove and an inside face. A liner in the shell comprises a palm liner panel having an outside face adapted for engagement by the palm of the hand when the hand is in the shell and an inside face facing the inside face of the front panel of the glove. The front panel and the palm liner panel have lower edge margins turned inwardly so that the outside face of the front panel is in opposing face-to-face relation with the outside face of the palm liner panel. Means is provided securing the lower edge margins to one another in outside face-to-outside face relation thereby to form a flexible heel seam running across the bottom of the glove with said securing means being substantially concealed from view. A relatively thin flexible heel pad is disposed between the front panel and the palm liner panel above the heel seam. The front panel and the palm liner panel, as secured together by said flexible heel seam, combine with the flexible heel pad to form a heel construction which is readily flexible to facilitate closing of the glove.

In another aspect of the invention, means is provided for holding the heel pad in fixed position comprising a line of seam through the front panel and the palm liner panel. The flexible heel pad, as held in position by said line of seam, and the front panel and palm liner panel, as secured together by the flexible heel seam, combine to form a flexible heel construction which is readily flexible to facilitate closing of the glove.

Other objects and features will be in part apparent and in part pointed out hereinafter.

BRIEF DESCRIPTION OF THE DRAWINGS

Corresponding reference numerals indicate corresponding parts throughout the several views of the drawings.

DESCRIPTION OF THE PREFERRED EMBODIMENT

Figure 1:
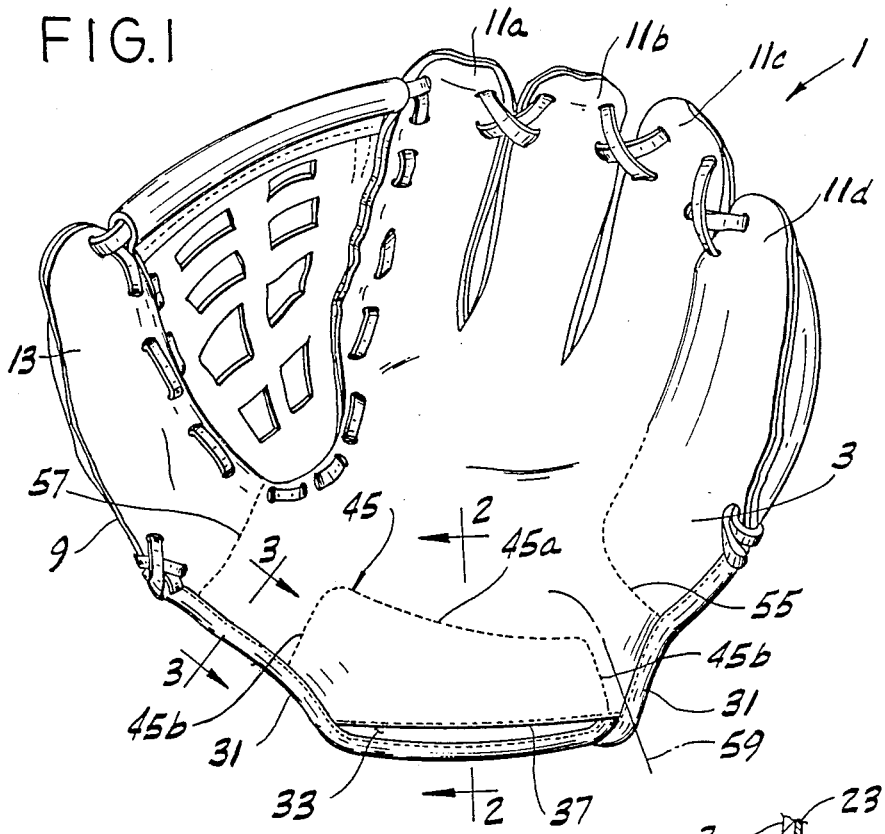
FIG. 1 is a front elevational view of a glove having a flexible heel construction of this invention.
Figure 3:
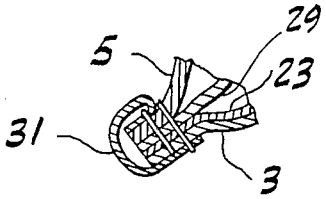
FIG. 3 is an enlarged section on line 3—3 of FIG. 1.
Figure 4:
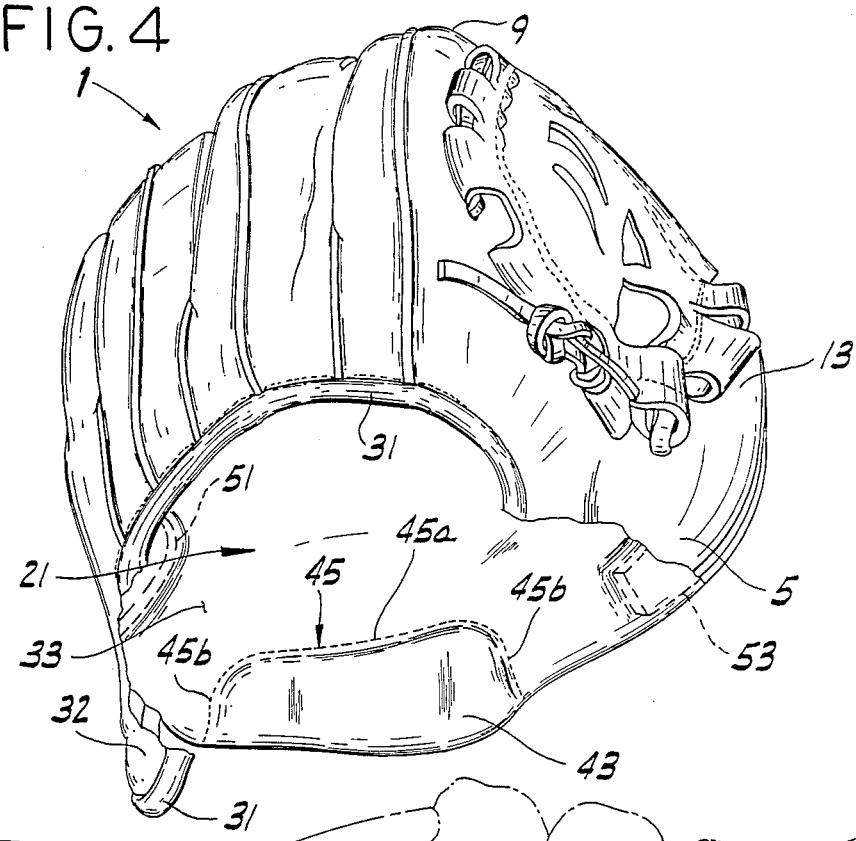
FIG. 4 is a rear elevational view of the glove with portions (e.g., the wrist strap) removed for clarity.
Figure 5:
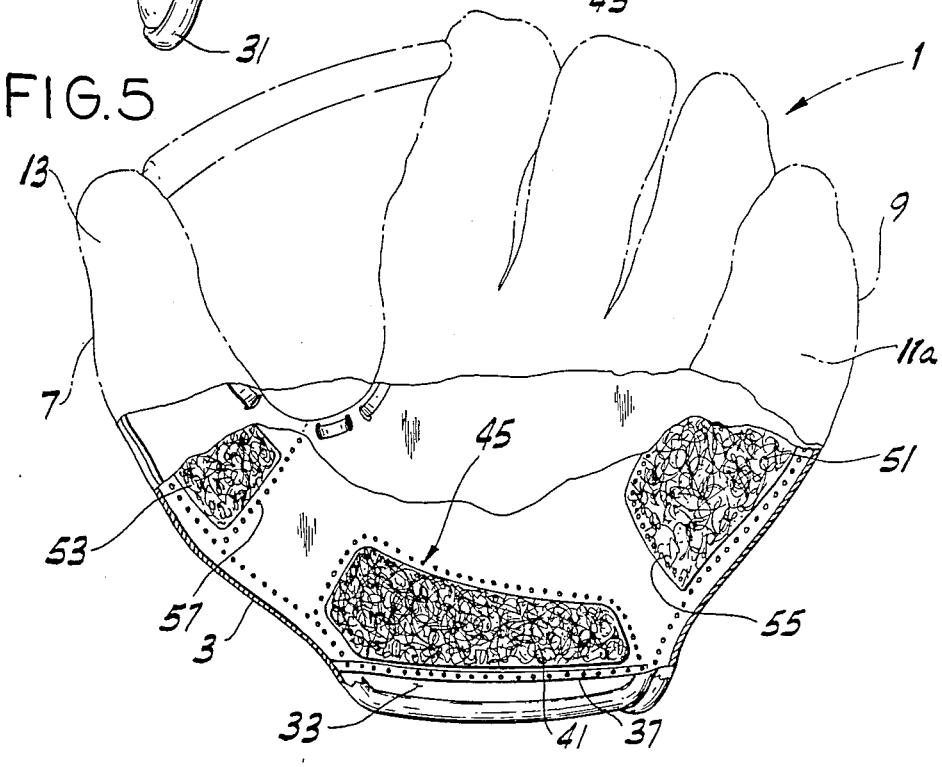
FIG. 5 is a view similar to FIG. 1 with portions removed to show a heel pad.

Referring now to the drawings, and first more particularly to FIGS. 1 and 4, there is generally indicated at 1 a glove with a flexible heel construction of the present invention. The glove comprises a front panel 3 forming the front wall of the glove and a back panel 5 forming the back wall of the glove. The front and back panels are secured (e.g., sewn) together in conventional fashion at peripheral margins of the glove to form a glove shell 9 having a plurality of finger stalls, designated 11*a*–11*d*, and a thumb stall designated 13. The front panel 3 of the glove has an outside face 15 forming the front surface of the glove and an inside face 17 (see FIG. 3). Disposed in the shell 9 is a liner, generally designated 21, comprising a palm liner panel 23 having an outside face 25 for engagement by the palm of the hand when the hand is in the shell 9, and an inside face 27 facing the inside face 17 of the front panel 3 of the glove. The liner also includes a back liner panel 29 engageable with the back of the hand when the hand is in the glove. Along the sides of the glove from about midway of the sides down to the bottom of the glove the edge margins of the front panel 3, the palm liner panel 23, the back liner panel 29 and the back panel 5 are stitched flatwise together as shown in FIG. 3 an are covered by trim 31 constituted by a folded-over strip of material stitched to the front and back panels of the glove. As shown trim 31 continues on the back of the glove and borders a conventional wrist strap 32 and hand opening 33.

Figure 2:
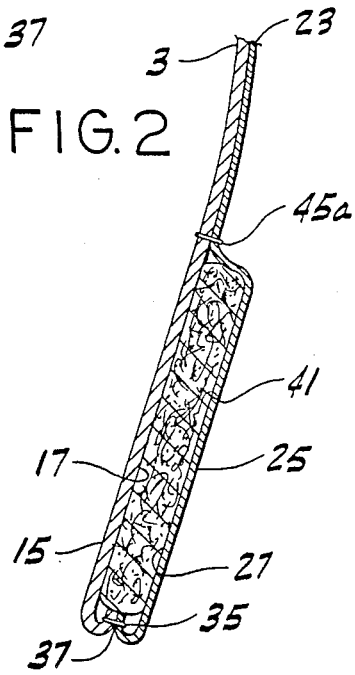
FIG. 2 is an enlarged cross-sectional view on line 2—2 of FIG. 1.

In accordance with this invention, and as best illustrated in FIG. 2, the front panel 3 and palm liner panel 23 have lower edge margins adjacent the bottom of the glove turned inwardly (upwardly as viewed in FIG. 2) so that the outside face 15 of the front panel is in opposing face-to-face relation with the outside face 25 of the palm liner panel, the edge margins being secured together in outside face-to-outside face relation by means comprising stitching 35 to form a flexible finished heel seam 37 extending across the bottom of the glove (as illustrated, the heel seam 37 constitutes the bottom edge of the heel of the glove). The heel seam 37 is substantially concealed from view, which lends not only an attractive finished appearance to the bottom of the glove, but also protects the stitching 35 against wear and exposure to the elements for greater durability.

A relatively thin (e.g., ⅛ in.-thick) flexible heel pad 41 of suitable material (e.g., wool or a wool blend) is disposed between the front panel 3 and the palm liner panel 23 at the bottom of the glove in a pocket 43 defined by a line of seam generally designated 45 comprising an upper reach 45*a* of seam extending across the glove at a location spaced above the flexible heel seam 37 to form a top edge of the stated pocket 43, and a pair of spaced-apart side reaches of seam, each designated 45*b*, extending between the upper reach 45*a* and the bottom of the glove to form opposite side edges of the pocket 43. The line of seam 45 is preferably constituted by stitching which extends through the front panel 3 and the palm liner panel 23 of the glove, although it will be understood that the stitching could also extend through the peripheral margins of the heel pad without departing from the scope of this invention. The glove 1 has a little finger pad and a thumb pad, indicated at 51 and 53, respectively, located between the front panel 3 and the palm liner panel 23. The little finger pad 51 is held in place by a line of stitching 55 and the thumb pad is held in place by a line of stitching 57. It will be noted that the glove will naturally tend to close along a "break" or hinge line 59 constituted by an area of the glove which extends generally parallel and immediately to the right (as viewed in FIG. 1) of seam 45*b* down to the bottom of the heel of the glove, since there is no padding or trim between the front panel 3 and palm liner panel 23 in this area (the glove thickness thus corresponding only to the combined thicknesses of the palm panel 3 and palm liner panel 23), and since the heel seam 37 is a flexible seam.

Thus, the stated construction wherein the heel pad (41) is relatively thin and flexible, wherein the bottom of the glove is finished by a flexible heel seam (e.g., 37) without the need for binding or lacing, wherein the heel pad is held in place by a flexible line of seam (e.g., 45) rather than lacing, and wherein there is a flexible "break" (e.g., 59) in the glove, makes the heel of the glove extremely flexible so that the glove may readily be closed with only a minimum of effort, even by a child having relatively little hand strength.

In view of the above, it will be seen that the several objects of the invention are achieved and other advantageous results. attained.

As various changes could be made in the above constructions without departing from the scope of the invention, it is intended that all matter contained in the above description or shown in the accompanying drawings shall be interpreted as illustrative and not in a limiting sense.

What is claimed is:

1. A baseball glove with a flexible heel construction, comprising a front panel forming the front wall of the glove and a back panel forming the back wall of the glove, said front and back panels being secured together at peripheral margins of the glove to form a glove shell having finger and thumb stalls for receiving the fingers and the thumb of the hand, said front panel having an outside face forming the front surface of the glove and an inside face, and a liner in the shell comprising a palm liner panel having an outside face adapted for engagement by the palm of the hand when the hand is in the shell and an inside face facing the inside face of the front panel of the glove, said front panel and said palm liner panel having lower edge margins turned inwardly so that the outside face of the front panel is in opposing face-to-face relation with the outside face of the palm liner panel, means securing said lower edge margins to one another in outside face-to-outside face relation thereby to form a flexible heel seam running across the bottom of the glove with said securing means being substantially concealed from view, and a relatively thin flexible heel pad disposed between the front panel and the palm liner panel above said flexible heel seam, said front panel and said palm liner panel, as secured together by said flexible heel seam, combining with the flexible heel pad to form a heel construction which is readily flexible to facilitate closing of the glove.

2. A baseball glove as set forth in claim 1 further comprising means for holding said heel pad in fixed position comprising a line of seam through said front panel and said palm liner panel.

3. A baseball glove as set forth in claim 1 wherein said line of seam comprises an upper reach of seam extending across the glove at a location spaced above said heel seam to form a top edge of a pocket for said heel pad, and a pair of spaced-apart side reaches extending between said upper reach and said heel seam to form opposite side edges of the pocket.

4. A baseball glove as set forth in claim 3 wherein said line of seam comprises stitching.

5. A baseball glove as set forth in claim 4 wherein said securing means comprises a line of stitching.

6. A baseball glove as set forth in claim 3 wherein said glove is formed to close along a hinge line constituted by an area of glove extending generally parallel to one of said side reaches of seam, said area of glove being relatively thin and flexible and having a thickness corresponding only to the combined thicknesses of said palm liner panel and said front panel.

7. A baseball glove with a flexible heel construction, comprising a front panel forming the front wall of the glove and a back panel forming the back wall of the glove, said front and back panels being secured together at peripheral margins of the glove to form a glove shell having finger and thumb stalls for receiving the fingers and the thumb of the hand, said front panel having an outside face forming the front surface of the glove and an inside face, and a, liner in the shell comprising a palm liner panel having an outside face adapted for engagement by the palm of the hand when the hand is in the shell and an inside face facing the inside face of the front panel of the glove, said front panel and said palm liner panel having lower edge margins secured together to form a flexible finished heel seam across the bottom of the glove, a relatively thin heel pad disposed between the front panel and the palm liner panel above said heel seam, and means for holding said heel pad in fixed position comprising a line of seam through said front panel and said palm liner panel, said flexible heel pad, as held in position by said line of seam, and said front panel and palm liner panel, as secured together by said flexible heel seam, combining to form a flexible heel construction which is readily flexible to facilitate closing of the glove.

8. A baseball glove as set forth in claim 6 wherein said line of seam comprises an upper reach of seam extending across the glove at a location spaced above said heel seam to form a top edge of said pocket, and a pair of spaced-apart side reaches extending between said upper reach and said heel seam to form opposite side edges of the pocket.

9. A baseball glove as set forth in claim 8 wherein said line of seam comprises stitching.

10. A baseball glove as set forth in claim 8 wherein said glove is formed to close along a hinge line constituted by an area of glove extending generally parallel to one of said side reaches of seam, said area of glove being relatively thin and flexible and having a thickness corresponding only to the combined thicknesses of said palm liner panel and said front panel.

11. A baseball glove as set forth in claim 7 wherein said lower edge margins of the front panel and palm liner panel are turned inwardly so that the outside face of the front panel is in opposing face-to-face relation with the outside face of the palm liner panel, and means securing said lower edge margins to one another in outside face-to-outside face relation thereby to form said heel seam across the bottom of the glove with said securing means being substantially concealed from view.

12. A baseball glove as set forth in claim 11 wherein said securing means comprises a line of stitching.

* * * * *